US008096819B1

(12) United States Patent
Rosero et al.

(10) Patent No.: US 8,096,819 B1
(45) Date of Patent: Jan. 17, 2012

(54) SAFETY AND OBSTRUCTIVE DEVICE FOR AN ELECTRICAL OUTLET

(76) Inventors: Alejandro Rosero, Hamilton, NJ (US); Teresa Rosero, Hamilton, NJ (US); Diana Rosero-Pena, Hamilton, NJ (US)

( * ) Notice: Subject to any disclaimer, the term of this patent is extended or adjusted under 35 U.S.C. 154(b) by 55 days.

(21) Appl. No.: 12/799,336

(22) Filed: Apr. 22, 2010

Related U.S. Application Data

(60) Provisional application No. 61/215,756, filed on May 8, 2009.

(51) Int. Cl.
*H01R 13/44* (2006.01)

(52) U.S. Cl. ..... 439/135; 439/521

(58) Field of Classification Search ..... 439/135–145, 439/373, 520–521
See application file for complete search history.

(56) References Cited

U.S. PATENT DOCUMENTS 4,045,108 A 8/1977 Olsen
4,302,624 A 11/1981 Newman
4,737,599 A 4/1988 Fontaine
4,952,756 A 8/1990 Meyers
5,011,419 A 4/1991 Maan
5,288,945 A 2/1994 Bruce
5,477,010 A 12/1995 Buckshaw et al.
5,813,873 A 9/1998 McBain et al.
5,944,542 A 8/1999 Lee
6,364,673 B1 4/2002 Lee
6,767,229 B1 7/2004 Wang
6,780,031 B1 8/2004 Valls
6,942,502 B2 9/2005 Sharples
6,984,139 B1 1/2006 Lai

*Primary Examiner* — Khiem Nguyen
(74) *Attorney, Agent, or Firm* — Fox Rothschild LLP; Richard C. Woodbridge; Perry M. Fonseca

(57) ABSTRACT

A protective cover and electric outlet arrangement includes an outlet body, the outlet body having a socket unit with insertion holes for receiving an electric plug, a non-specific design protective cover coupled to the outlet body and bendable to frictionally engage and expand open an access way to the insertion holes of the protective cover to socket unit and upon withdrawal of the electrical plug return of the non-specific design protective cover to an obstructive position to obstructively close access to the insertion holes of the socket unit, and the non-specific design protective cover being a safety structure adapted to selectively obscure the socket with a decorative design incorporating the receiving apertures of the socket that mate with each of the prongs of the electrical plug.

13 Claims, 5 Drawing Sheets

SAFETY AND OBSTRUCTIVE DEVICE FOR AN ELECTRICAL OUTLET

PRIORITY DATE CLAIMED

The priority date claimed is May 8, 2009, the filing date assigned to a co-pending provisional application for a patent on this invention bearing Ser. No. 61/215,756.

NOTICE OF COPYRIGHT CLAIMS TO MATERIAL IN DISCLOSURE

A portion of the disclosure in this document displays or discloses material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates generally to electric sockets and, more specifically, to a protective cover and electric outlet arrangement with a non-specific outward design, which has an obstructive means to selectively obstruct entry of a plug and thereby operate as a static protective cover with no specific ornamental design exhibited.

2. Description of the Prior Art

Electric wall outlet plugs are usually at a level where children at an early age find them practically at eye level. Since children observe adults pushing plugs into these outlets, their propensity for imitation prompts them to attempt to do the same. Consequently, because they have small fingers, they seek to push their fingers into the slots of the wall outlet. If they reach the hot side of the outlet, this can cause severe electric shock and perhaps death due to any shorting to a ground whereby current is enabled to pass through the child.

Attempts have been made to solve this problem by providing spring-biased rotating discs, for example, on a wall plug which require manual rotation to permit penetration of the plug prongs. Some of these devices require installation by a licensed electrician or they consist of double plugs which can easily be removed by a two or three-year old child. Other more cumbersome box-like protectors require a squeezing action to be removed but these are cumbersome and do not always operate as intended. They project from the wall to the extent that they may be knocked off or fractured by contact with furniture, vacuum cleaners and the like.

U.S. Pat. No. 6,364,673 was issued to Lee on Apr. 2, 2002 for an electrical outlet cover having a pair of floating socket covers which are resiliently urged toward a first position wherein holes in the floating socket covers are not aligned with holes in the electrical outlet. This floating socket cover by Lee must be rotated from a first position to a second position wherein holes in the socket cover are aligned with holes in the protective cover by Lee and then pushed toward the socket for moving the desired prongs on the plug into the respective desired holes in the socket. While prongs on the plug are moving into holes on the socket the prongs are covered by the floating socket cover to prevent electrical shock resulting from touching prongs of a plug that is partially plugged into the electrical socket.

Illustrative of the intricate approaches to this safety problem is an earlier invention by Lee described in U.S. Pat. No. 5,944,542, which discloses an oblique spring-loaded plate device that at first look shields the prongs on an electric plug as the plug is being pushed into or removed from an electrical outlet but reveals and allows entry into the outlet upon rotation of the plug when it is partly inserted into the spring-loaded plate. The spring-loaded plate device includes a hollow housing, a faceplate having holes for receiving prongs on an electric plug and a compression spring. The face plate is movably mounted within the housing and rotatable within the housing, with the compression spring extending between the face plate and the housing such that the housing extends forward of the face plate and toward an electrical outlet when the adapter is mounted over the electrical outlet. As the prongs on the electrical plug are inserted into the socket in the electrical outlet, the housing extends around the prongs, covering the prongs. This apparatus protects against engaging prongs of the plug when it is partially plugged into the outlet. The Lee devices are complex and expensive to manufacture because they require precisely fitting parts. The Lee devices do discourage insertion of metallic objects, such as paper clips, into a socket by children and provide a means for hiding the holes in the socket from children.

A variety of other socket covers and plugs have been devised to make it difficult for children to insert fingers or other objects into unused electrical outlets. U.S. Pat. Nos. 5,011,419 and 5,813,873 disclose cumbersome and expensive slidable plates having slots for the prongs on a plug which are biased to a position wherein the slots on the slidable cover are not aligned with openings in the outlet. For inserting a plug into an electrical outlet, the slidable cover is moved to a position wherein the slots are aligned with openings in the electrical outlet so that the prongs can move through the slots in the slidable cover into the electrical outlet.

A swivel outlet cover is also commercially available which replaces existing outlet plates. A spring-loaded swivel cover having holes formed therein which conform to the configuration of an electrical outlet socket can be rotated for aligning holes in the cover with the holes in the socket for insertion of a plug. The cover swivels to a closed position preventing access to the holes in the electrical outlet socket when the outlet is not in use. This cover is popular with outdoor ground fault protected outlets for both 110 V and 220 V electric sources.

The swivel outlet cover and the slidable covers aid in preventing children from putting fingers or small objects into the electrical outlet socket. However, when a plug is partially inserted into the outlet socket, portions of the prongs are exposed which may result in electrical shock if contacted.

Other protective devices include covers that fit over unused electrical outlets which can be removed by squeezing and lifting the cover from the outlet. Completely obstructive outlet plugs made of insular plastic are also available which fit into standard electrical outlets to help protect children from electrical shock.

A long felt need exists for an electrical outlet cover, which serves a dual function of discouraging and resisting insertion of small objects into an unused electrical socket, which also esthetically obscures the socket thereby protecting against unintended engagement of prongs or blades on an electric plug with the socket.

OBJECTS OF THE INVENTION

A primary object of the present invention is to provide a partially obstructing means that resists insertion of a plug into a socket and concomitantly obscures the socket without conflicting with any decorative aspect of the socket plate or the room in which the socket is located.

Another object of the present invention is to partially and temporarily block insertion of one or more electrically conductive protrusions of a plug except under a rocking linear insertion force different than normally or customarily required without obscuring and totally blocking a socket and at the same time presenting a transparent or translucent, namely clear, camouflaged outer appearance.

It is yet another object of the present invention to provide a camouflaged wall outlet protector which is virtually unnoticeable in appearance or non-obtrusive from a home decorating point of view while having only a slight partial projection in front of the apertures of the plug to partly block and/or partly impede a plug from being inserted into the wall plug plate except by using an amount of insertion force not usually and customarily or casually produced by a person attempting to insert a plug into an outlet.

It is a further object to provide an outlet protector, which can be readily applied to an existing outlet plate by a homeowner, not requiring any tools, and readily usable requiring only hand pressure or force, and necessitating no contact with the electrical connections of the outlet or alteration thereof.

It is a further object to provide an outlet protector, which automatically closes as a plug is withdrawn.

It is still yet an additional object to provide an outlet protector that is both decorative and functional such that if the level of the outlet is raised to counter height as for a high end kitchen with a marble splash board, or above a sofa, or at a level next to the middle of the back of an easy chair where one might want to plug in a power cord of the power supply of a laptop, it is not substantially detractive from the surrounding décor.

SUMMARY OF THE INVENTION

Presented is an electrical outlet cover for an electrical outlet having a socket comprising:

a cover plate having a hollow cup, an aperture, and a socket cap located in the aperture; said socket cap located in said hollow cup, said socket cap having a slot for receiving a prong of an electrical plug, the slot being reversibly closed with a bridge, the bridge being reversibly opened by insertion of said plug, the bridge having a left side having a left edge and a right side having a right edge, the right edge being juxtaposed against the left edge; and, the right and left edges in said socket cap completely blocking entry into said socket cap, the socket cap preventing movement of said prong beyond the bridge toward the socket until the edge of an aperture in said socket cap has been flexibly resiliently bent using an applied linear force orthogonal to the cover plate to a position directly above said slots wherein said slot in the socket cap is aligned with the opening in the socket whereby said prong can pass beyond said right and left edges into the socket. The electrical outlet cover for an electrical outlet having a socket having a hollow cup, an aperture, and a socket cap located in the aperture; said socket cap located in said hollow cup, said socket cap having a reversibly closed slot for receiving a prong of an electrical plug, the slot being reversibly closed with a bridge.

BRIEF DESCRIPTION OF THE DRAWINGS

For a full and plenary understanding of the nature of the present invention, reference should be had to the following detailed description taken in connection with the accompanying drawings in which.

In all of the figures the screw for attaching the cover plate at the center is the usual and customary standard screw customarily used to mount face plates over electrical sockets wherein the novel camouflage cap with disguised apertures has been added.

Like reference letters and numerals refer to like parts throughout the several views of the drawings, and the novel invention can be fully understood from the detailed specification provided below, to wit:

DETAILED DESCRIPTION OF THE PREFERRED EMBODIMENT

Figure 1:
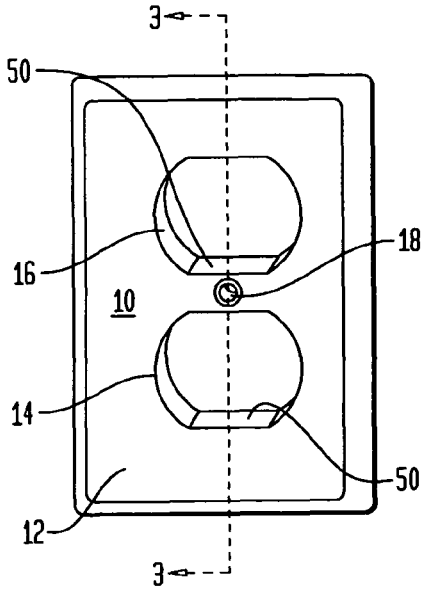
FIG. 1 is a perspective view of a front part of a cover plate with two apertures and showing a direction for a plane cross-section 3-3 depicted in FIG. 3; and, FIG. 2 is a rear view of the cover plate shown in FIG. 1 showing a direction for a plane cross-section 4-4 depicted fully in FIG. 4; and, FIG. 3 is a view of the cross-section 3-3 for the cover plate marked in FIG. 1; and, FIG. 4 is a view of the cross-section 4-4 for the cover plate marked in FIG. 2; in accordance with the novel invention; and, FIG. 5 is a front view of a novel camouflaging cap for an electrical outlet in accordance with the invention showing a direction for a cross-sectional view at the plane 6-6; and, FIG. 6 is a cross-sectional view of the novel camouflaging cap at the plane 6-6; and, FIG. 7 is a rear view of the novel camouflaging cap for an electrical outlet shown in FIG. 5 showing a direction for a cross-sectional view at the plane 8-8, and, FIG. 8 is a cross-sectional view of the novel camouflaging cap at the plane 8-8; and, FIG. 9 depicts two versions of combinations of novel caps made in accordance with the invention in a flow diagram for assembly with a cover plate to form a novel combination of a cover plate and a cap camouflaging and blocking an electrical outlet.
Figure 2:
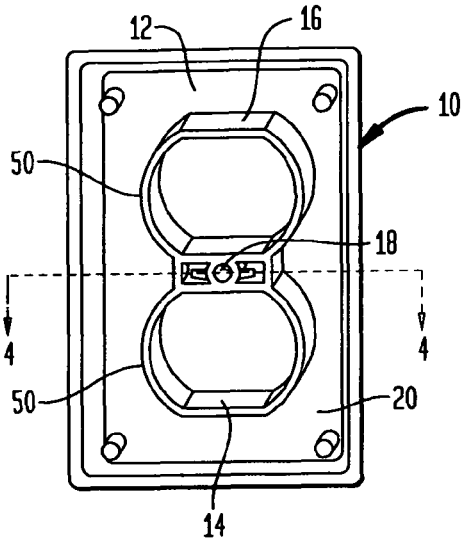
Figure 3:
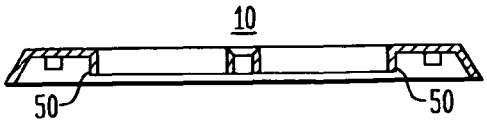
Figure 4:
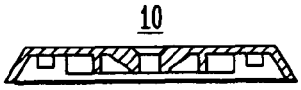

A front view of a standard cover 10 for two electrical sockets (not shown) is shown in FIG. 1. The cover has an outside 12 with at least one aperture 14 and preferably another aperture 16. A rear view of the cover 10 is shown in FIG. 2. There are shown the apertures 14 and 16. The cover 10 is preferably attached to a wall outlet with a screw (not shown) extended through a hole 18. The cover 10 has an inside 20 formed to provide a hollow cavity 20 as shown in FIG. 2. A cross-section of the cover 10 taken at the plane 4-4 is shown in FIG. 4.

Figure 5:
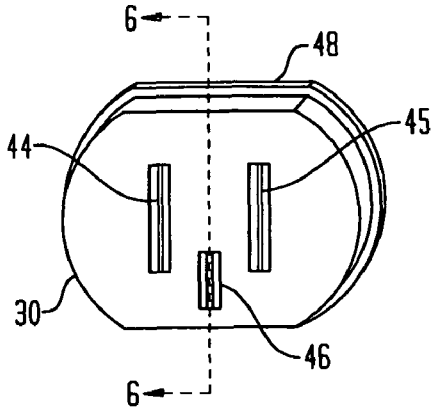
Figure 7:
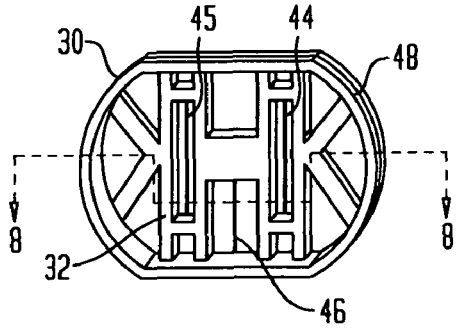
Figure 6:
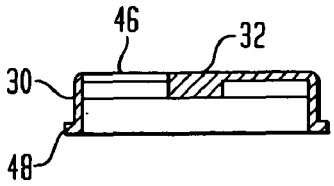

An example of a front view of the novel invention is shown in perspective in FIG. 5. There is shown a novel cap 30. A cross-section of the cap 30 taken along a plane 6-6 is shown in FIG. 6. In FIG. 7 there is shown a rear view of the novel cap 30. Another cross-section along the plane 8-8 of the cap 30 as shown in FIG. 7 is illustrated in FIG. 8.

Figure 8:
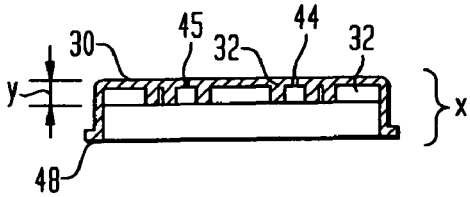

Referring to FIGS. 6 and 8, the novel cap 30 is shown having a thickness X. A sub-structure 32 occupying the underside of the cap 30 is shown in FIG. 7. This sub-structure 32 is shown in FIG. 7 as an integral connected grid work encompassing three slots 44, 45, and 46. These slots 44, 45, and 46 are completely but reversibly closed.

Referring to FIGS. 5, 6, and 7, a lip 50 (shown in FIGS. 1 and 2) is located around the entire perimeter of the cap 30. The lip 50 is shaped to congruently overlap and removably engage a perimeter 48 of the aperture 14 and/or aperture 16.

A material suitable and preferable for the cover plate 10 shown in FIGS. 1, 2, 3, and 4 is a copolymer called ABS or acrylonitrile butadiene styrene. The material exhibits the necessary strength, rigidity, and toughness to enable the novel cap 30 to function as required when inserted in the aperture 14 and/or aperture 16 shown in FIGS. 1 and 2. Preferred specifications for a material for the cover 10 are as shown below in a table of specifications entitled "TECHNICAL DATA ABS", to wit:

Technical Data ABS

In the preferred embodiment, ABS is used for the cover plate 10. ABS (Acrylonitrile-Butadiene-Styrene) is a copolymer composed of two copolymers and is one of the most common polymer materials. Styrene and Acrylonitrile form a linear copolymer (SAN) that serves as a matrix. Butadiene and Styrene also form a linear copolymer (BS rubber) which acts as the filler material. The combination of the two copolymers gives ABS an excellent combination of strength, rigidity, and toughness.

| ASTM or UL test | Property | ABS |
|---|---|---|
| | PHYSICAL | |
| D792 | Density (lb/in$^3$) | 0.038 |
| | (g/cm$^3$) | 1.04 |
| D570 | Water Absorption, 24 hrs (%) | — |
| | MECHANICAL | |
| D638 | Tensile Strength (psi) | 6,500 |
| D638 | Tensile Modulus (psi) | 340,000 |
| D638 | Tensile Elongation at Break (%) | 25 |
| D790 | Flexural Strength (psi) | 11,000 |
| D790 | Flexural Modulus (psi) | 320,000 |
| D695 | Compressive Strength (psi) | — |
| D695 | Compressive Modulus (psi) | — |
| D785 | Hardness, Rockwell | R105 |
| D256 | IZOD Notched Impact (ft-lb/in) | 7.0 |
| | THERMAL | |
| D696 | Coefficient of Linear Thermal Expansion ($\times 10^{-5}$ in/in/° F.) | 5.3 |
| D648 | Heat Deflection Temp (° F./° C.) at 264 psi | 215/102 |
| D3418 | Melting Temp (° F./° C.) | —/— |
| — | Max Operating Temp (° F./° C.) | 140/60 |
| | Thermal Conductivity | |
| C177 | (BTU-in/ft$^2$-hr-° F.) | — |
| | ($\times 10^{-4}$ cal/cm-sec-° C.) | — |
| UL94 | Flammability Rating | H-B |
| | ELECTRICAL | |

-continued

| ASTM or UL test | Property | ABS |
|---|---|---|
| D149 | Dielectric Strength (V/mil) short time, ⅛" thick | — |
| D150 | Dielectric Constant at 60 Hz | — |
| D150 | Dissipation Factor at 60 Hz | — |
| D257 | Volume Resistivity (ohm-cm) at 50% RH | $10^{15}$ |

A material suitable and preferable for the cap 30 shown in FIGS. 5, 6, 7, and 8 is flexible PVC. A thickness for the flexible PVC used to make the novel cap 30 is 3.2 mm, for example.

The cap 30 shown in FIGS. 5, 6, 7, and 8 is preferably made of a PVC that is substantially clear, flexible, and elastic. Such a preferred PVC is polyvinyl chloride, specification no. 300H-75, for example. Preferable specifications for the cap 30 are illustrated below in the table of specifications for this particular PVC entitled "TECHNICAL DATA FOR PVC 300H-75 CLEAR", to wit:

Technical Data PVC 300H-75 Clear

PVC (polyvinyl Chloride) 300H-75 Clear is a flexible vinyl of high heat stability.

| TYPICAL PROPERTIES | 300H-75 | ASTM# |
|---|---|---|
| Durometer Shore A, ±3 15 Sec. | 75 | D-2240 |
| Specific Gravity ±0.03 | 1.21 | D-792 |
| Tensile Strength, psi | 2550 | D-412 |
| Ultimate Elongation, % | 480 | D-412 |
| 100% Modulus, psi | 1100 | D-412 |
| Low Temperature Brittleness Tb° C. | −50 | D-746 |
| Recommended Molding Temperature | 275-350° F. | |

Figure 9:
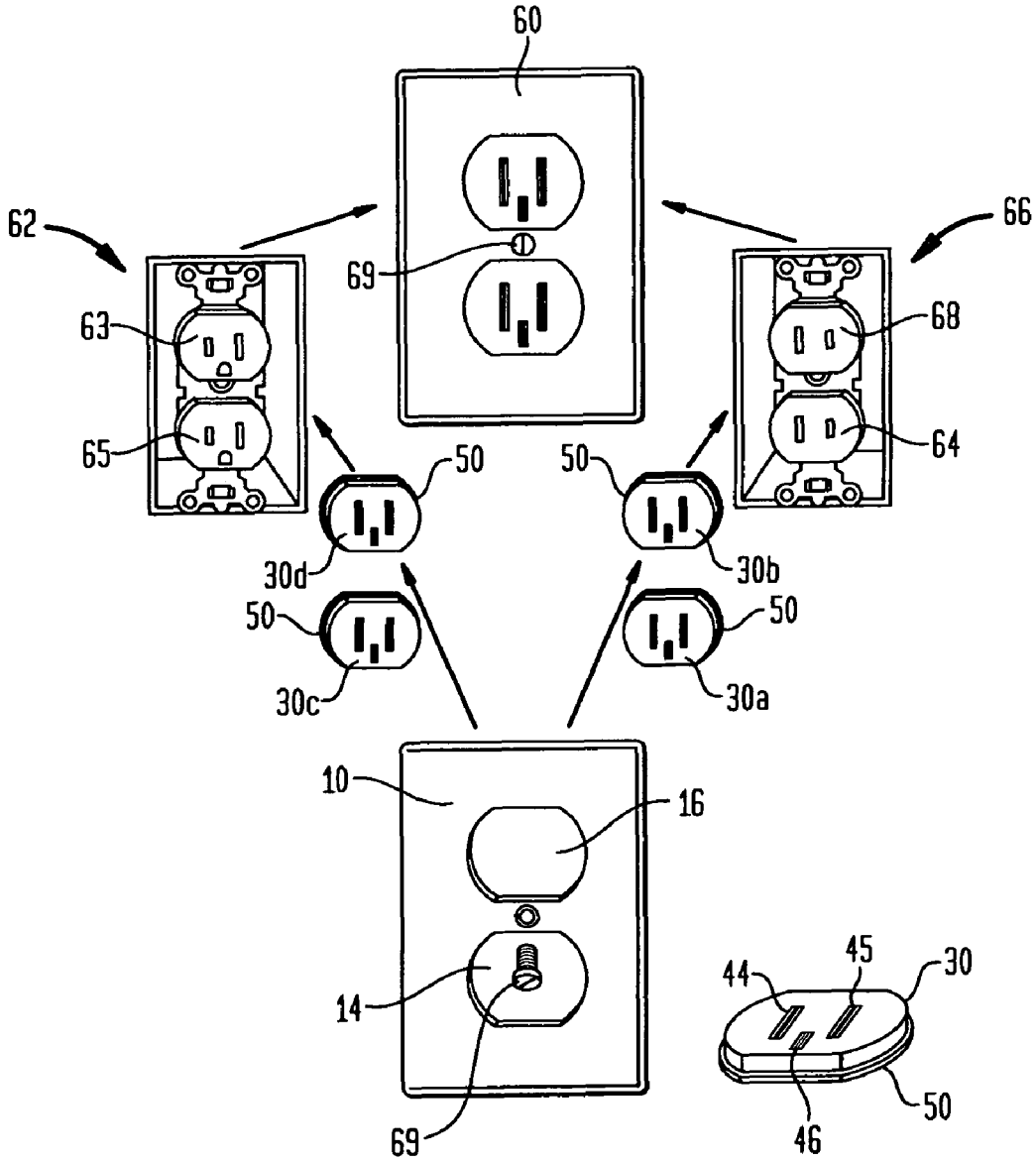

Referring to FIG. 9 there is shown a flow diagram of a method for using the novel cap 30 to provide a new and novel cover plate 60 for either an electrical outlet 62 comprising a pair of ground sockets 63 and 65 or an electrical outlet 66 comprising a pair of ungrounded sockets 64 and 68. The method comprises the step of providing a cover plate 10 and a screw 69, for example, for attaching the cover plate 10 to either the outlet 62 or the outlet 66 in the customary fashion. The method requires that for use of the outlet 66 with the ungrounded plugs 64 and 68 the entries to these plugs 64 and 68 are blocked or shielded by insertion of the caps 30*a* and 30*b*, respectively, into the apertures 14 and 16, respectively. Alternatively, the novel method requires that for use of the outlet 62 with the grounded plugs 63 and 65 as shown, the entries to these plugs 63 and 65 are blocked by inserting the caps 30*c* and 30*d*, respectively, into the apertures 14 and 16, respectively. The method comprises the step of providing lips 50 on each of the caps 30*a*, 30*b*, 30*c*, and 30*d* to hold the caps in place inside the apertures 14 and 16.

Figure 10A:
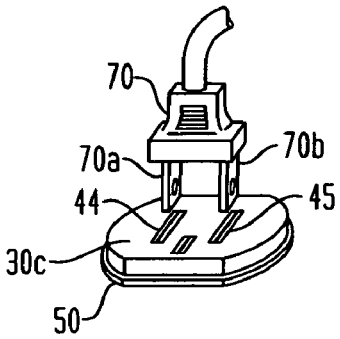
FIGS. 10*a*, 10*b*, and 10*c* taken together illustrate a preferred process of interaction between the novel blocking and camouflaging cap and a two-blade electrical plug in the process of being inserted into the cap; and, FIGS. 11*a*, 11*b*, and 11*c* taken together illustrate a preferred interaction between the novel blocking and camouflaging cap and a two-blade, one ground prong electrical plug being inserted into the cap in accordance with the novel invention; and, FIGS. 12*a*, 12*b*, and 12*c* taken together illustrate a micro view of the novel interaction between the novel cap and a customary plug wherein the mechanism for selectively blocking and unblocking access to an electrical outlet is provided.
Figure 10B:
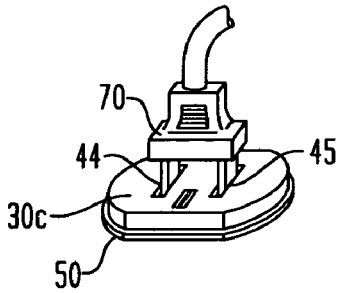
Figure 10C:
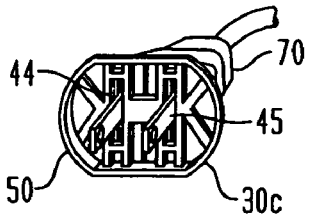
Figure 11A:
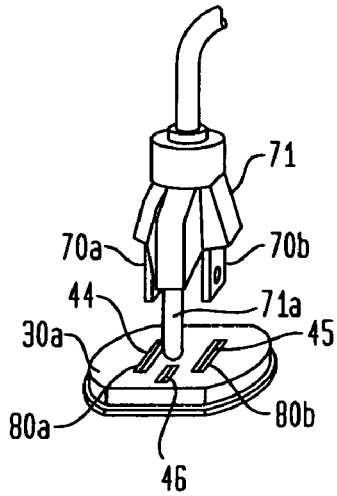
Figure 11B:
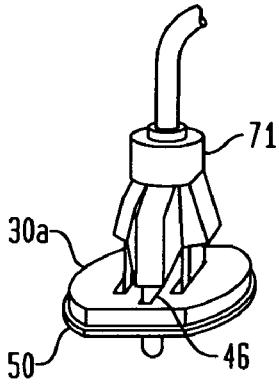

Now referring to FIGS. 10*a*, 10*b*, and 10*c* there is shown a plug 70 wherein the method comprises the step of inserting the plug 70 into the cap 30*c* wherein blades 70*a* and 70*b* are engaged in the step of being inserted into the slots 44 and 45 shown in FIG. 5. Further referring to FIGS. 11*a*, 11*b*, and 11*c* there is shown in similar fashion, a plug 71 with the blades 70*a* and 70*b* in addition to a ground prong 71*a* which are engaged in the step of being inserted into the slots 44 and 45 of the cap 30*a* in addition to the prong 71*a* being inserted through the slot 46 in the cap 30*a*. In FIG. 11*b* the prong 71*a* and the blades 70*a* and 70*b* are shown penetrating the slots 44, 45, and 46.

Figure 11C:
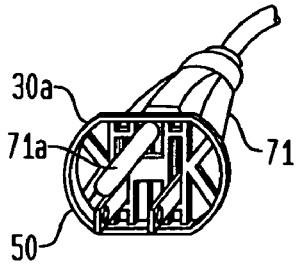

In FIG. 11*c* the prong 71*a* and the blades 70*a* and 70*b* are shown extending completely through the cap 30*a* sufficiently to enter either the plug 62 or the plug 66 and make an electrical connection to the wiring underneath (not shown).

Figure 12A:
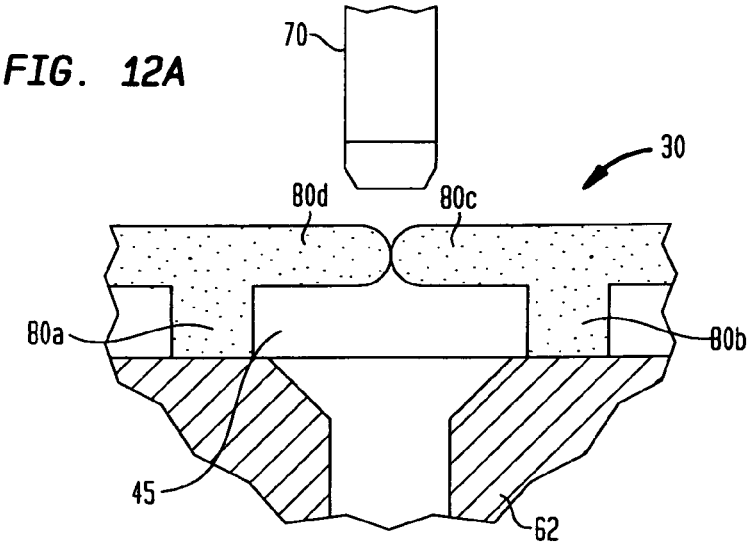
Figure 12B:
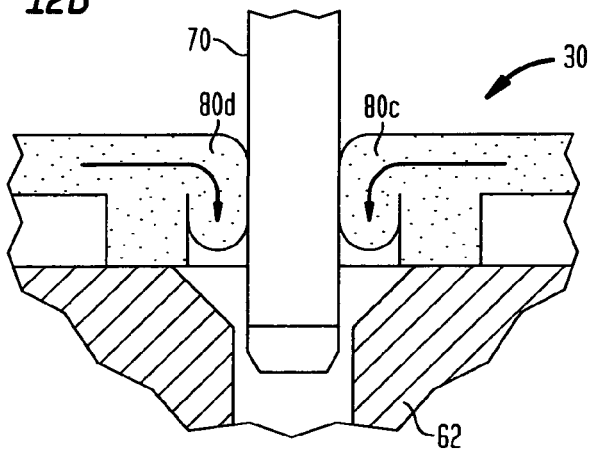
Figure 12C:
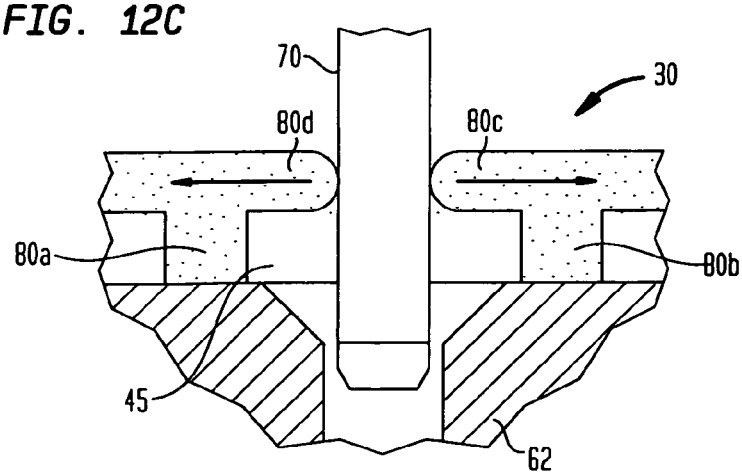

Now referring to FIGS. 12*a*, 12*b*, and 12*c* there is shown in amplified detail the novel operation created for opening and closing the novel slots that block and permit access through them to the opening below that house the contacts with at least two electrical contacts and optionally a contact that leads to ground. Parts 80*a*, 80*b*, 80*c*, and 80*d* make up the bridge.

The preferred insertion resistance force is measured and selected using a number of factors including the frictional drag on the surfaces of the prongs of the plug produced by the encountered perimetric lines of the novel camouflage cover. Hence, the extent to which the known perimetric lines contact the plug prongs and the smoothness of the surfaces of the prongs determines the insertion resistance force to some extent.

This insertion resistance may be characterized in kilograms per centimeter (kpc) based on the measured perimeters of the two flat prongs and one circular prong, e.g. 0.25 cm to 0.6 cm, for example. An insertion force of, for example, 0.1 to 0.5 kilograms is estimated to be sufficient to overcome the insertion resistance of standard sized brass plugs, for example. However, it is postulated that one of ordinary skill in the mechanical arts using this disclosure as a template can experiment with various thicknesses of the sheets used to make the covers to determine an optimum based on a selected strength.

It will be apparent to those skilled in the art that various changes may be made to the embodiment presented herein by using equivalent mechanical means without departing from the scope of the invention; and therefore, the invention is not to be limited to what is described in the specification and shown in the drawings, but only as indicated in the appended claims and their equivalents in accordance with the doctrine of equivalents.

What is claimed is:

1. A cover plate for an electrical outlet having a socket comprising:

a cover plate having a hollow cup, an aperture, and a camouflaging socket cap located in the aperture;

said camouflaging socket cap located in said hollow cup, said camouflaging socket cap having a slot flexibly around a slit for receiving a prong of an electrical plug, the slot being reversibly closedly camouflaged with a bridge, the bridge being reversibly opened by insertion of said plug, the bridge having a left side having a left edge and a right side having a right edge, the right edge being juxtaposed against the left edge; and, the slit being the right and left edges in said socket cap completely blocking entry into said socket cap, the socket cap preventing movement of said prong beyond the bridge toward the socket until the edge of an aperture in said socket cap has been flexibly resiliently bent using an applied linear force orthogonal to the cover plate to a position directly above said slots wherein said slot in the socket cap is aligned with the opening in the socket whereby said prong can pass beyond said right and left edges into the socket.

2. The cover plate of claim 1 being a cover for an electrical outlet having a socket wherein the socket cap further comprises said socket cap located in the aperture, said socket cap having a reversibly closed slot for receiving a conductive protrusion of an electrical plug, the slot being reversibly closed with a bridge.

3. The cover plate of claim 2 wherein the bridge is resilient and flexible.

4. The electrical outlet cover for an electrical outlet having a socket according to claim 3 further comprising a slit in the middle of the the bridge and wherein the bridge is reversibly opened by insertion of said plug and reversibly closed by withdrawing said plug.

5. The electrical outlet cover for an electrical outlet having a socket according to claim 4 further comprising the bridge having a left side having a left edge and a right side having a right edge, the right edge being juxtaposed to the left edge.

6. The electrical outlet cover for an electrical outlet having a socket in accordance with claim 5 wherein the right and left edges in said socket cap completely block entry into said socket cap and wherein the socket cap obstructs movement of said prong beyond the bridge toward the socket unless the right and left edges of the aperture in said socket cap have been flexed and bent open.

7. The electrical outlet cover for an electrical outlet having a socket in accordance with claim 5 wherein the edge of the aperture in said socket cap is made of a flexible material, the edge being capable of being flexibly bent using an applied rocking linear force on the electrical plug that is orthogonal to the cover plate to a position and directly above said slot.

8. The electrical outlet cover for an electrical outlet having a socket according to claim 6 wherein the bridge is made of a resilient material and wherein the edge of the aperture in said socket cap can be reversibly bent open using an applied linear force orthogonal to the cover plate to a position directly above said slots.

9. The electrical outlet cover for an electrical outlet having a socket in accordance with claim 7 wherein the edge of an aperture in said socket cap can be flexibly resiliently reversibly bent using an applied linear force from the prong orthogonal to the cover plate, the prong being located at a position directly above said slot wherein said slot is a raised ridge in the socket cap aligned with the opening in the socket whereby said prong can pass beyond said right and left edges into the socket.

10. An electrical outlet cover for an electrical outlet having a socket comprising:

a cover plate having a hollow cup, an aperture, and a socket cap located in the aperture;

said socket cap located in said hollow cup, said socket cap having a slot for receiving a prong of an electrical plug, the slot being reversibly closed with a bridge, the bridge being reversibly opened by insertion of said plug, the bridge having a left side having a left edge and a right side having a right edge, the right edge being juxtaposed to the left edge; and, the right and left edges in said socket cap completely blocking entry into said socket cap, the socket cap preventing movement of said prong beyond the bridge toward the socket until the edge of an aperture in said socket cap has been flexibly resiliently bent using an applied linear force orthogonal to the cover plate to a position directly above said slots wherein said slot in the socket cap is aligned with the opening in the socket whereby said prong can pass beyond said right and left edges and make an electrical connection in the socket.

11. A socket cover plate for a socket of an electrical outlet, the socket cover plate having an inside and an outside, the inside receiving at least one substantially clear socket cap, the socket cap being positioned over an electrical outlet socket and having a series of random linear ridges traversing the socket in myriad directions, at least two of the ridges having therein a slot for receiving a blade of an electrical plug and one of the ridges having therein a slot for inserting a prong on a plug into an opening in the socket of the electrical outlet.

12. In an electrical outlet cover for an electrical outlet, the improvement comprising a socket in accordance with claim 11 wherein the edge of an aperture in said socket cap flexibly resiliently reversibly bends, said slot being a raised ridge in the socket cap aligned with the opening in the socket.

13. In an electrical outlet cover for an electrical outlet the improvement comprising a socket having a cover plate having a hollow cup, an aperture, and a socket cap located in the aperture; said socket cap located in said hollow cup, said socket cap having a receiving slot for receiving a prong of an electrical plug, the slot being reversibly closed with a bridge, the bridge being reversibly opened by insertion of the plug, the bridge having a left side having a left edge and a right side having a right edge, the right edge being juxtaposed to the left edge; and, the right and left edges in said socket cap reversibly resiliently completely blocking entry into said socket cap, whereby said prong can pass beyond said right and left edges and move into said slot sufficiently to make an electrical connection in the socket.

* * * * *